US006626602B1

(12) United States Patent
Yuen

(10) Patent No.: US 6,626,602 B1
(45) Date of Patent: Sep. 30, 2003

(54) HANGING FILE SYSTEM

(75) Inventor: Man Sum Yuen, Hong Kong (HK)

(73) Assignee: Idea Enhancement Group, Inc., South Gate, CA (US)

( * ) Notice: Subject to any disclaimer, the term of this patent is extended or adjusted under 35 U.S.C. 154(b) by 11 days.

(21) Appl. No.: 09/710,201

(22) Filed: Nov. 9, 2000

(51) Int. Cl.[7] ..... B42F 13/00

(52) U.S. Cl. ..... 402/73; 206/425; 211/46; 229/67.2; 281/43; 312/184; 402/4

(58) Field of Search ..... 211/45, 46; 281/43; 312/184, 183; 402/73, 4, 80 R, 8; 206/308.3, 425; 229/67.1, 67.2; 248/302

(56) References Cited

U.S. PATENT DOCUMENTS

| | | | | | |
|---|---|---|---|---|---|
| 3,865,445 | A | * | 2/1975 | Dean et al. | 312/184 |
| 4,009,784 | A | * | 3/1977 | Elias et al. | 211/113 |
| 4,133,590 | A | * | 1/1979 | Young | 281/21.1 |
| 4,181,381 | A | * | 1/1980 | St. Amand | 211/165 |
| 4,288,170 | A | * | 9/1981 | Barber | 281/43 |
| 4,312,453 | A | * | 1/1982 | Barber | 211/16 |
| 4,445,799 | A | * | 5/1984 | Wright et al. | 281/21.1 |
| 4,979,626 | A | * | 12/1990 | Pitts | 211/45 |
| 5,088,801 | A | * | 2/1992 | Rorke et al. | 312/184 |
| 5,163,768 | A | * | 11/1992 | Salisbury et al. | 402/3 |
| 5,197,762 | A | * | 3/1993 | Abramov | 281/43 |
| 5,328,259 | A | * | 7/1994 | Meriaux | 312/184 |
| 5,709,494 | A | * | 1/1998 | Deutsch | 281/36 |
| 5,993,099 | A | * | 11/1999 | Greenberg et al. | 211/42 |
| 6,227,746 | B1 | * | 5/2001 | Long et al. | 211/46 |

FOREIGN PATENT DOCUMENTS

| | | |
|---|---|---|
| CN | 338211 | 5/1999 |
| CN | 00228178.3 | 5/2000 |
| CN | 00228179.1 | 5/2000 |
| CN | 00228180.5 | 5/2000 |
| CN | 00228742.0 | 7/2000 |
| CN | 00228743.9 | 7/2000 |
| CN | 00238049.8 | 8/2000 |

* cited by examiner

*Primary Examiner*—Monica Carter
(74) *Attorney, Agent, or Firm*—Liu & Liu

(57) ABSTRACT

A hanging file system that makes use of an improved hanging binder. The filing system includes a number of complementary hanging file supports, implementations and accessories. In one aspect of the present invention, the hanging binder makes use of a common center post to support a telescopic section of the hanger members. In another aspect of the present invention, hanging binder supports are designed to complement usage of the hanging binder to provide filing of loose-leaf papers, such as a hanging file sleeve provides support for portable storage of hanging file, a hanging file carrying case provides easy handling of hanging files, and a foldable hanging file base may be folded during shipment or when the case is not in use. In another aspect of the present invention, a hanging binder supports a receptacle, such as an envelope or file pocket, that provides filing of lose papers and/or articles.

20 Claims, 8 Drawing Sheets

HANGING FILE SYSTEM

BACKGROUND OF THE INVENTION

1. Field of the Invention

This invention relates to paper filing systems, and more particularly to hanging file systems.

2. Description of Related Art

In the past, hanging folders were designed to help maintain papers neatly in file drawers. A hanging folder has hangers that extend from each end of the opening of the folder, which ride on rails provided across a file drawer. When papers are placed in the hanging folder, they are either first organized in a separate file folder or simply left loose in a stack. Chinese Utility Model Patent No. 982124627 (filed Apr. 2, 1998; issued May 24, 1999; assigned to Idea Enhancement Group Inc., the assignee of the present application), disclosed a new hanging binder that organizes, binds and files the papers in a hanging file drawer, without requiring the use of a separate hanging folder and file folder. (This Chinese patent is fully incorporated by reference herein) The hanging binder disclosed has four posts spaced apart along a binding spine and a binder flap having four holes spaced apart to match the posts. The papers to be filed have holes punched along an edge at spacing matching the location of the posts. To file a paper, the paper is placed against the binder with the posts through the holes, and the binder flap is closed onto the posts with the tip of the posts into the holes on the binder cover. The tips of the posts are snapped into the holes on the binder flap, thus securing the paper on the posts. To remove a paper, the binder flap is unsnapped to provide access to the paper. The hanging binder has a hanger extending from each end of its spine, which hangers may retract into the spine when the hanging binder is not placed in a hanging file drawer. Each hanger is separately supported in a cantilevered fashion by the two posts closest to the respective end.

The above-mentioned hanging binder maintains a stack of loose-leaf papers in an organized fashion for the convenience of future references. It also maintains the stack of loose-leaf papers in a manner that allows a person the flexibility and ease of inserting papers to or removing papers from the stack. Further, it maintains the stack of loose-leaf papers in a manner that allows easy turning of the pages to allow a person to review the papers.

The present invention provides an improvement over the earlier hanging binder design.

SUMMARY OF THE INVENTION

The present invention is directed to a hanging file system that makes use of an improved hanging binder. The filing system includes a number of complementary hanging file supports, implementations and accessories.

In one aspect of the present invention, the improved hanging binder has two telescopic retractable hanger members, which are supported by posts to extend at each end of the spine of the binder in a cantilevered manner. A common center post supports a telescopic section of the hanger members. This reduces the number of posts, thus simplifies the design and construction of the hanging binder, and improves ease of use.

In another aspect of the present invention, hanging binder supports are designed to complement usage of the hanging binder to provide filing of loose-leaf papers. In accordance with one embodiment of the present invention, a hanging file sleeve or box provides support for portable storage of hanging file. In accordance with another embodiment of the present invention, a hanging file carrying case provides easy handling of hanging files. In accordance with a further embodiment of the present invention, a foldable hanging file base provides support of hanging files. The foldable hanging file base has a frame structure that comprises slender members. Soft or flexible panels may be supported on the frame structure to provide protection of the contents from the environment. The frame structure may be folded or collapsed when the base is not in use.

In another aspect of the present invention, a hanging binder supports a receptacle that provides filing of lose papers and/or articles. In accordance with one embodiment of the present invention, the receptacle is in the form of a file pocket or envelope, with holes punched along an edge for hanging on the posts on the hanging binder.

BRIEF DESCRIPTIONS OF THE DRAWINGS

Figure 4A:
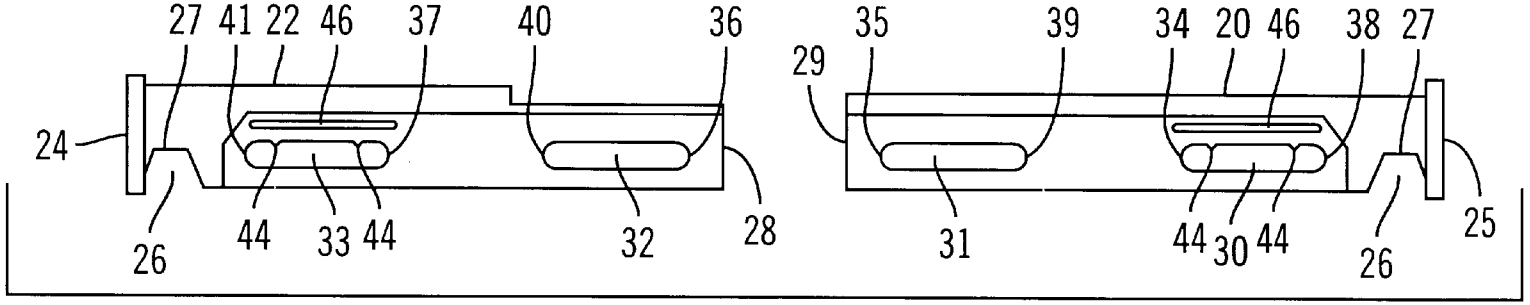
Figure 4B:
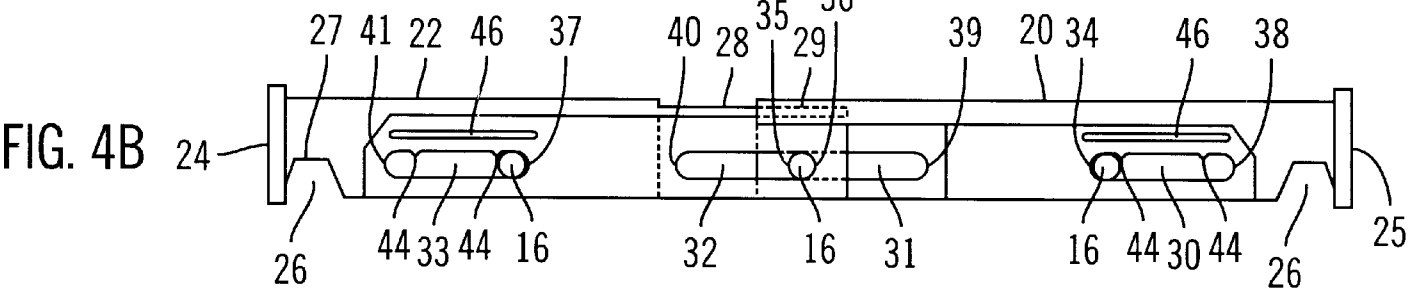
Figure 4C:
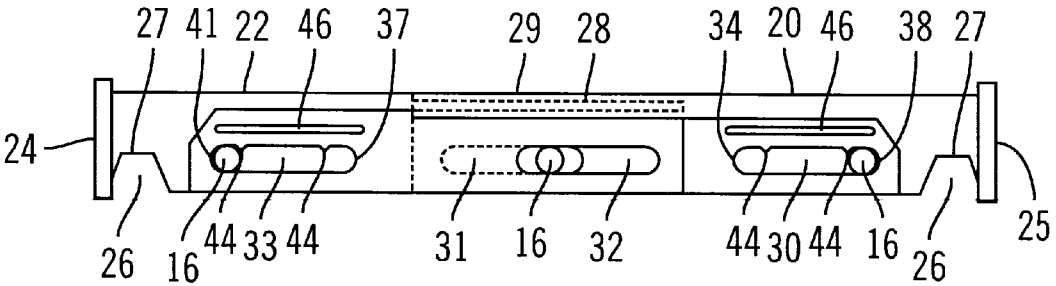

FIG. 4A is a front view of the hanger members separated; FIG. 4B is a front view of the hanger members in the extended state; FIG. 4C is a front view of the hanger members in the retracted state.

Figure 2:
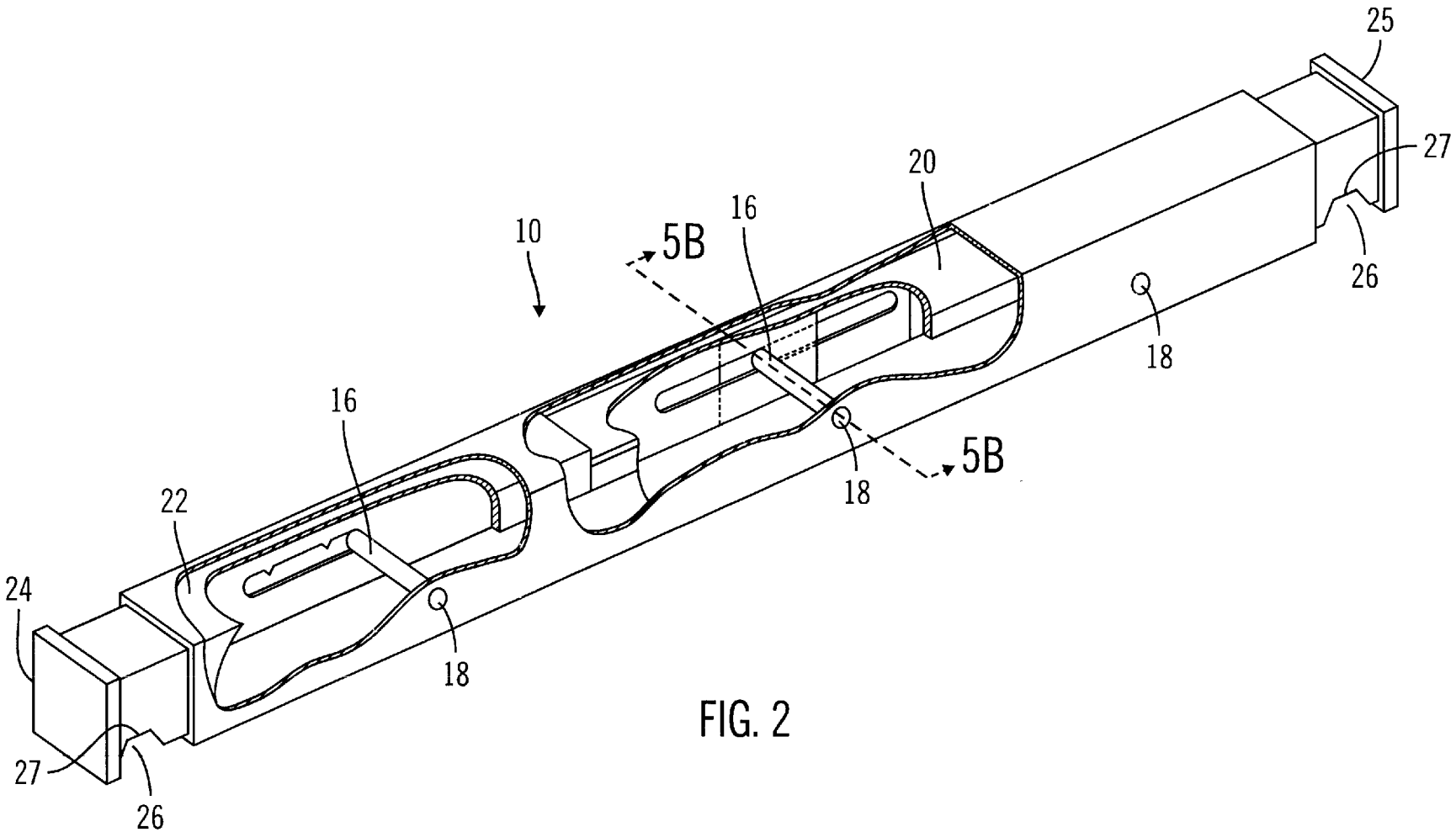
FIG. 2 is a perspective view of the hanging binder broken away to show internal parts, with the hangers fully extended.
Figure 3A:
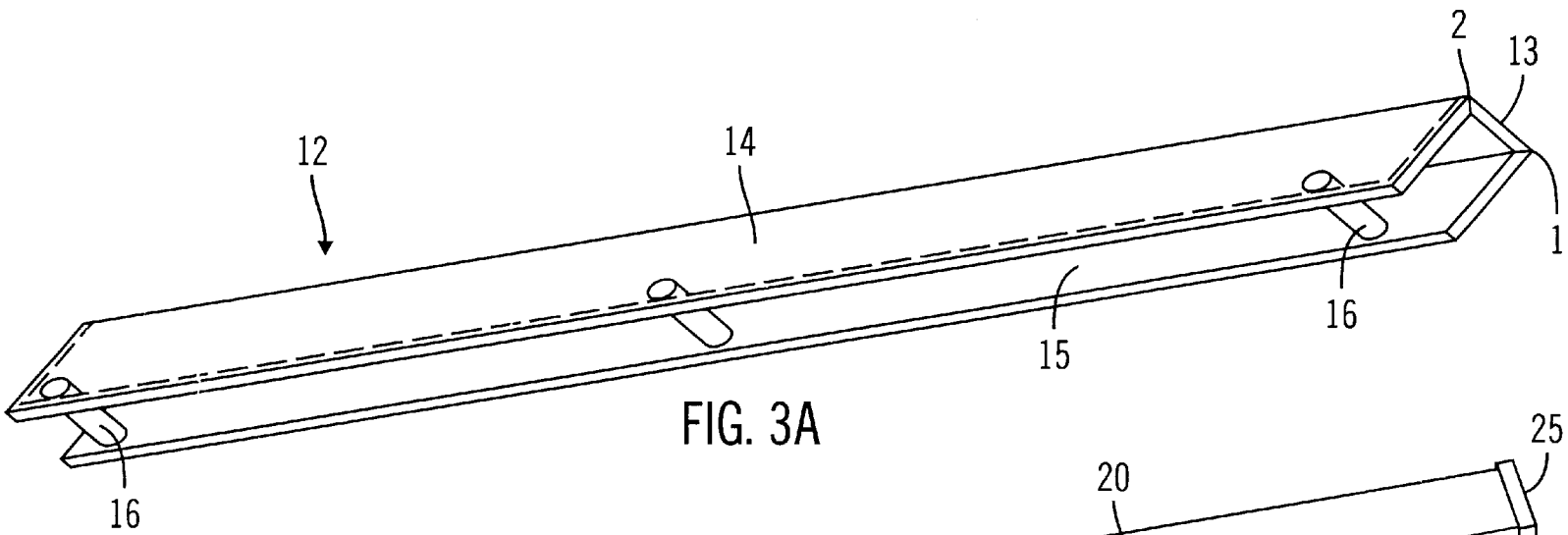
FIG. 3A is a perspective view of the spine of the binder.
Figure 3B:
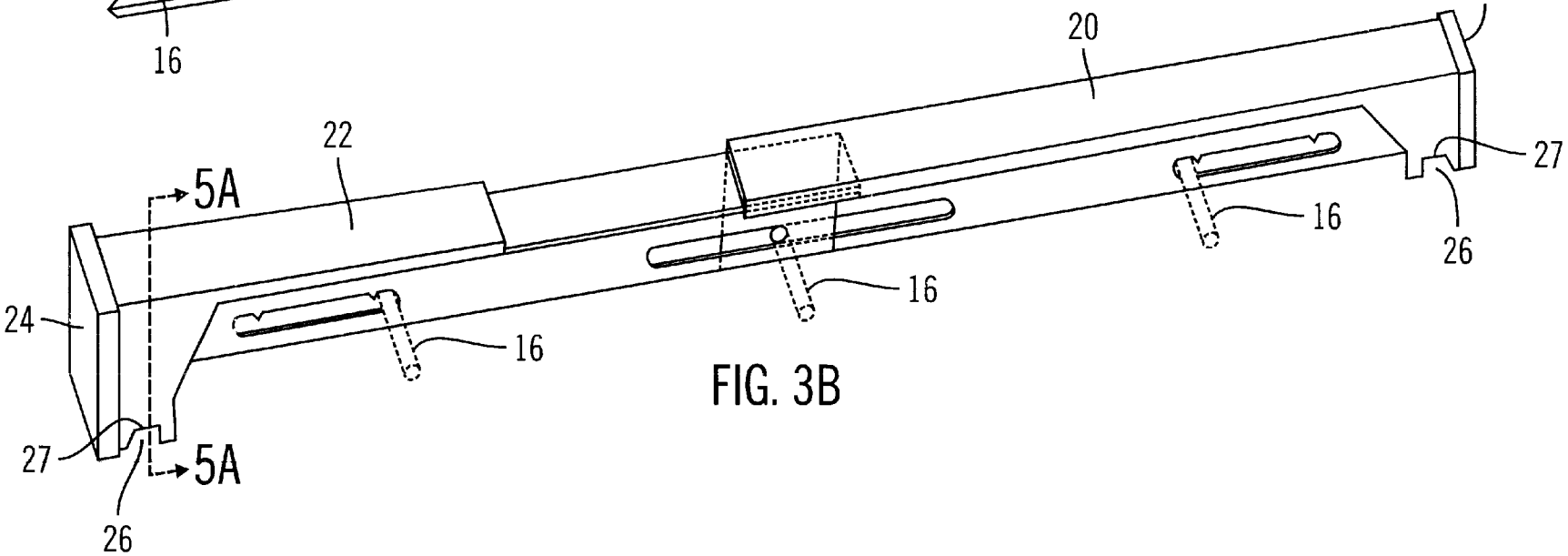
FIG. 3B. is a perspective view of the hanger members in the extended state.
Figure 5A:
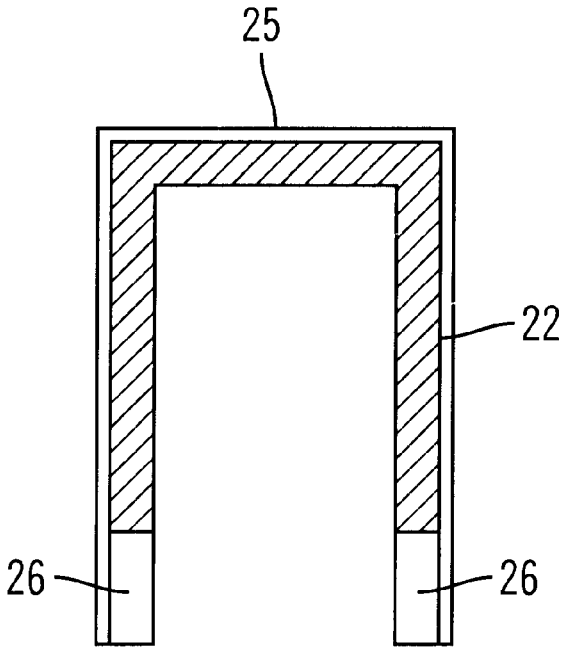
Figure 5B:
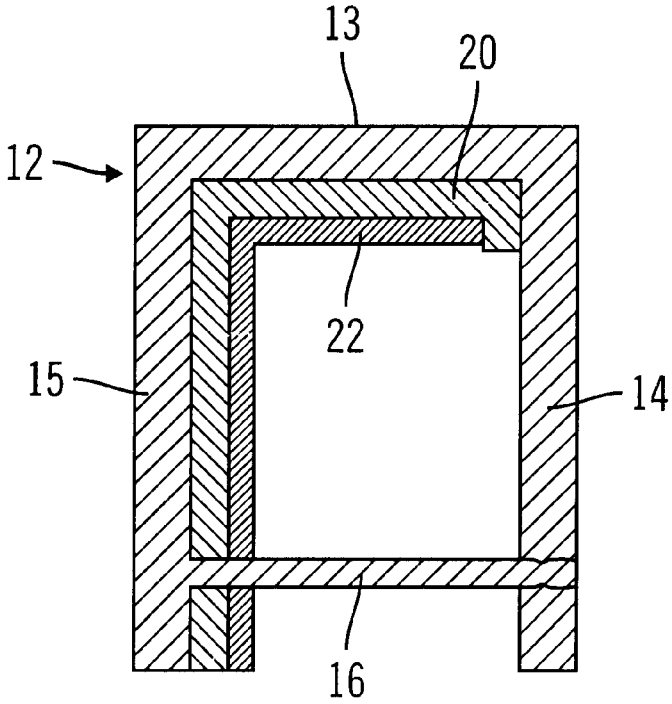

FIG. 5A is a sectional view of the hanger member taken along line 5A—5A in FIG. FIG. 3B; FIG. 5B is a sectional view of the binder taken along line 5B—5B in FIG. 2.

Figure 6:
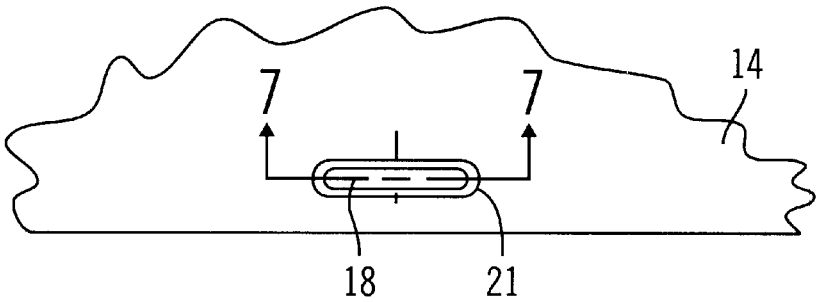

FIG. 6 is a top view of the post head region on the spine.

Figure 7:
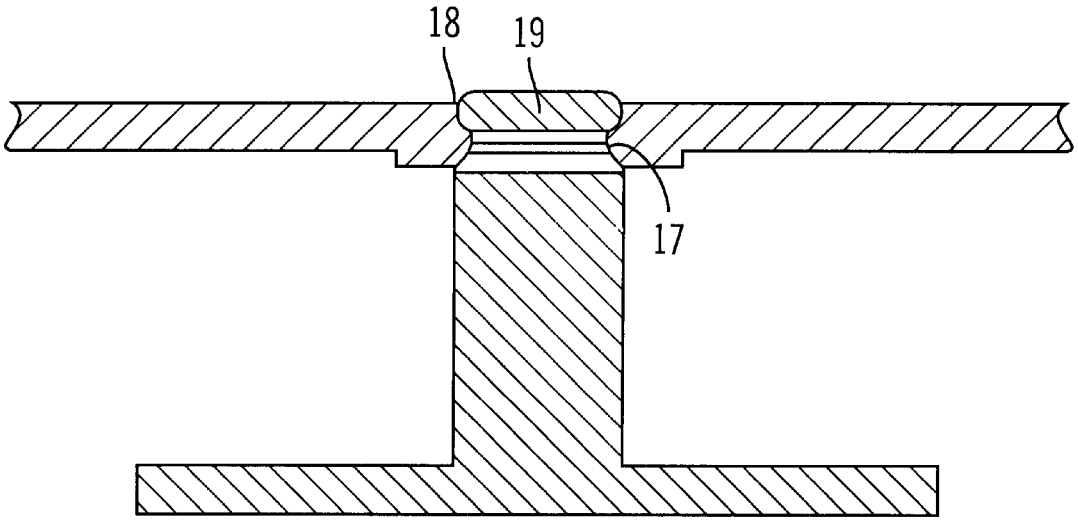

FIG. 7 is a sectional view of the post taken along line 7—7 in FIG. 6.

Figure 8:
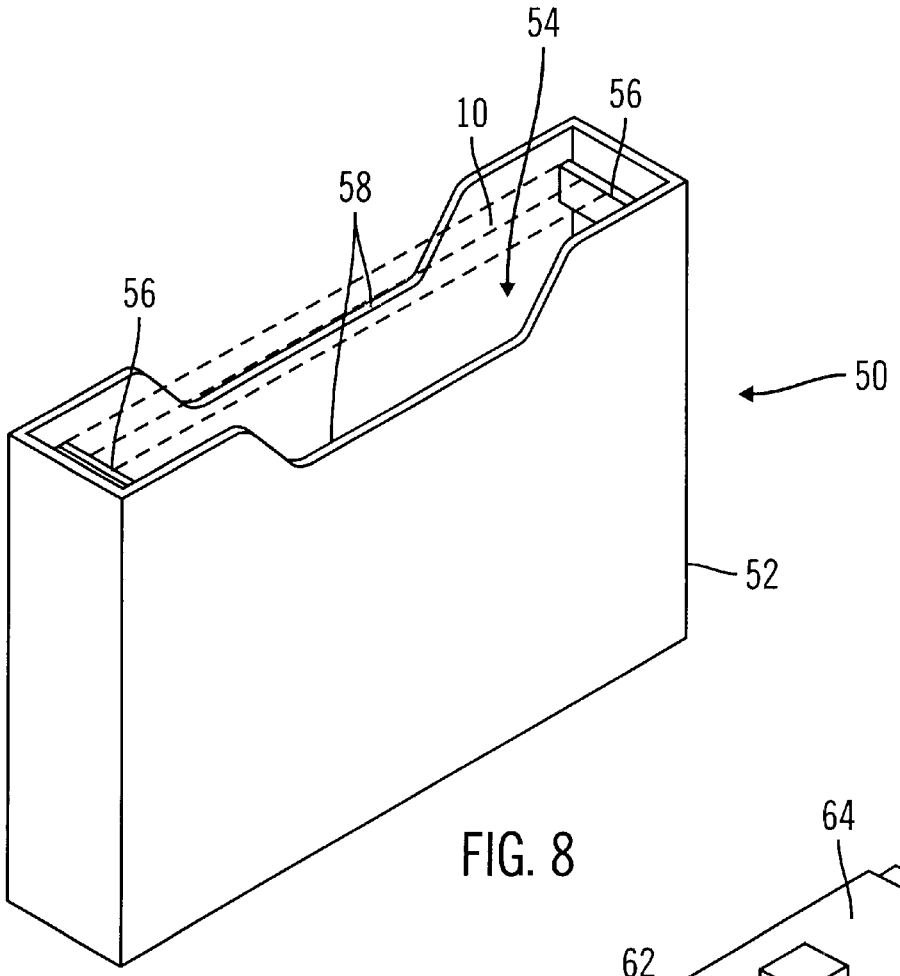

FIG. 8 is a perspective view of a hanging file box in accordance with one embodiment of the present invention.

Figure 9:
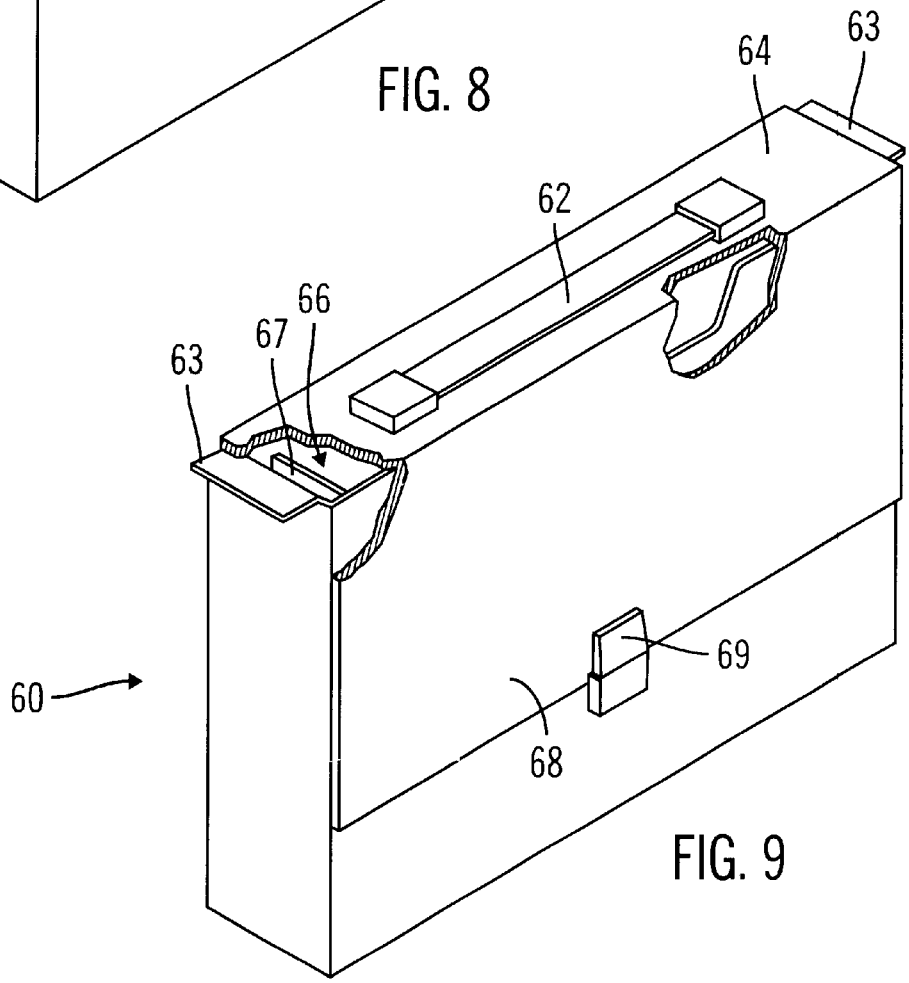

FIG. 9 is a perspective view of a hanging file carrying case in accordance with one embodiment of the present invention.

Figure 10:
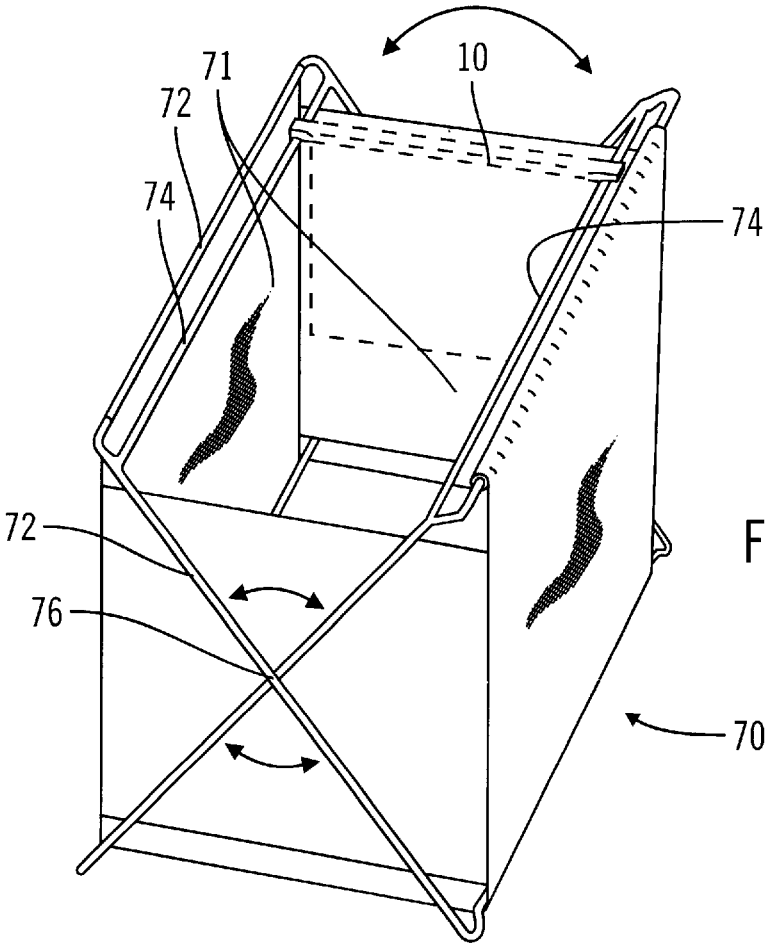

FIG. 10 is a perspective view of a foldable hanging file base in accordance with one embodiment of the present invention.

Figure 11:
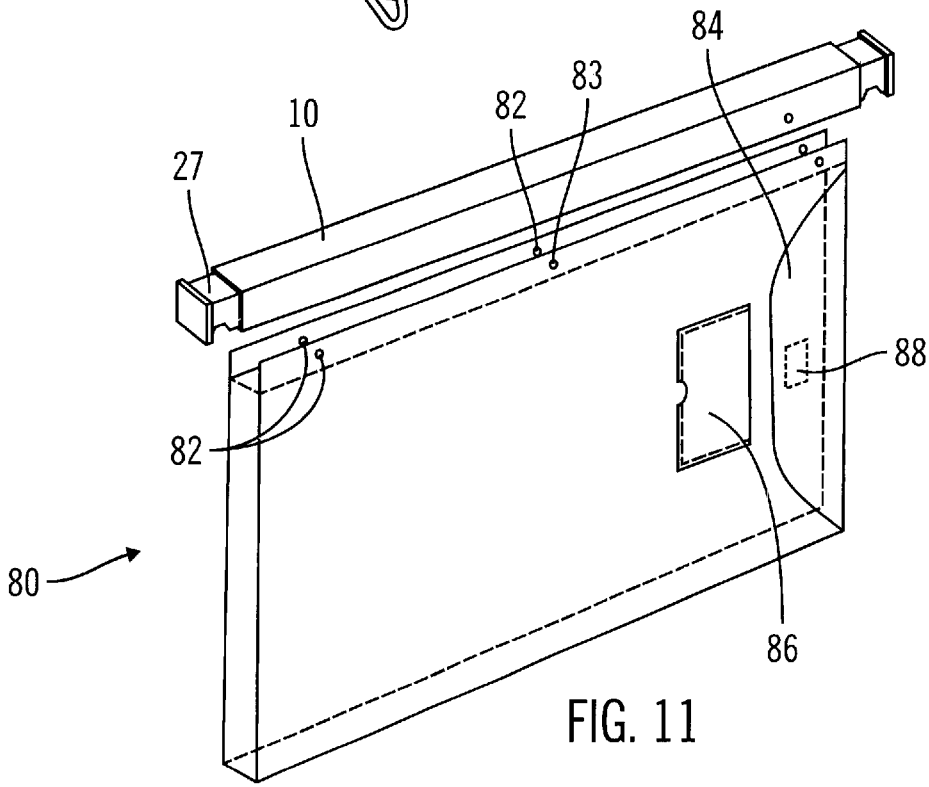

FIG. 11 is a perspective view of a hanging file pocket in accordance with one embodiment of the present invention.

DESCRIPTION OF PREFERRED EMBODIMENTS

The present description is of the best presently contemplated mode of carrying out the invention. This description is made for the purpose of illustrating the general principles of the invention and should not be taken in a limiting sense. The scope of the invention is best determined by reference to the appended claims.

Reference is made to Chinese Utility Model Patent No. 982124627 (filed Apr. 2, 1998; issued May 24, 1999; assigned to Idea Enhancement Group Inc., the assignee of the present application), which is fully incorporated by reference herein.

The present invention is directed to a hanging file system that makes use of an improved hanging binder. The filing system includes a number of complementary hanging file supports, implementations and accessories.

In one aspect of the present invention, an improved hanging binder reduces the number of posts required to support retractable hangers. FIGS. 1 to 5 illustrates the improved hanging binder in accordance with one embodiment of the present invention. The hanging binder 10 comprises an elongated spine 12 and two hanger members 20 and 22 slidable within the spine 12. The spine 12 has a generally U-shaped cross-section (i.e., generally a U-shaped channel; see FIG. 3A). It has a back 13 and two opposing flaps 14 and 15. The flap 15 has three posts 16 extending perpendicularly from the flap 15, across the inside of the spine of the spine 12, to the flap 14. The flap 14 is hingedly connected to the back 13 and has three holes 18 matching the location of the tips 19 of the posts. Referring also to FIGS. 6 and 7, the holes 18 have a constriction 21, and the posts 16 have a ball-head tip 19 and a neck 17. The ball-head tip 19, neck 17, hole 18 and constriction 21 are sized to cooperate as a snap fastener, such that the posts 16 and the holes 18 snaps together when the posts16 are inserted through the holes 18. The posts 16 and holes 18 may have a cylindrical, oval, square or rectangular cross-section. The illustrated embodiment shows an elongated oval cross-section. Alternatively, other types of releasable interlocking structure may be used for coupling the flap 14 and posts 16.

The spine 12 may be made of a plastic or light metal material. For example, plastic such as polyethylene and polyvinyl chloride may be used to make the spine. The flaps 14 and 15 and the back 13 may be formed from an initially flat piece of material. The flaps 14 and 15 may be bent from the back 13 and shaped to form the U-shaped (cross-section) spine 12. To facilitate bending, the sheet material may be scored at the bends 1 and 2 (FIG. 3A) or the thickness of the material is otherwise reduced at the bends. The bend 2 acts as a hinge for the flap 14. The posts 16 may be formed integral to the flap 15 or separately and welded to the flap 15. Alternatively, the flaps 14 and 15 may be separate pieces connected to the back 13.

Figure 1:
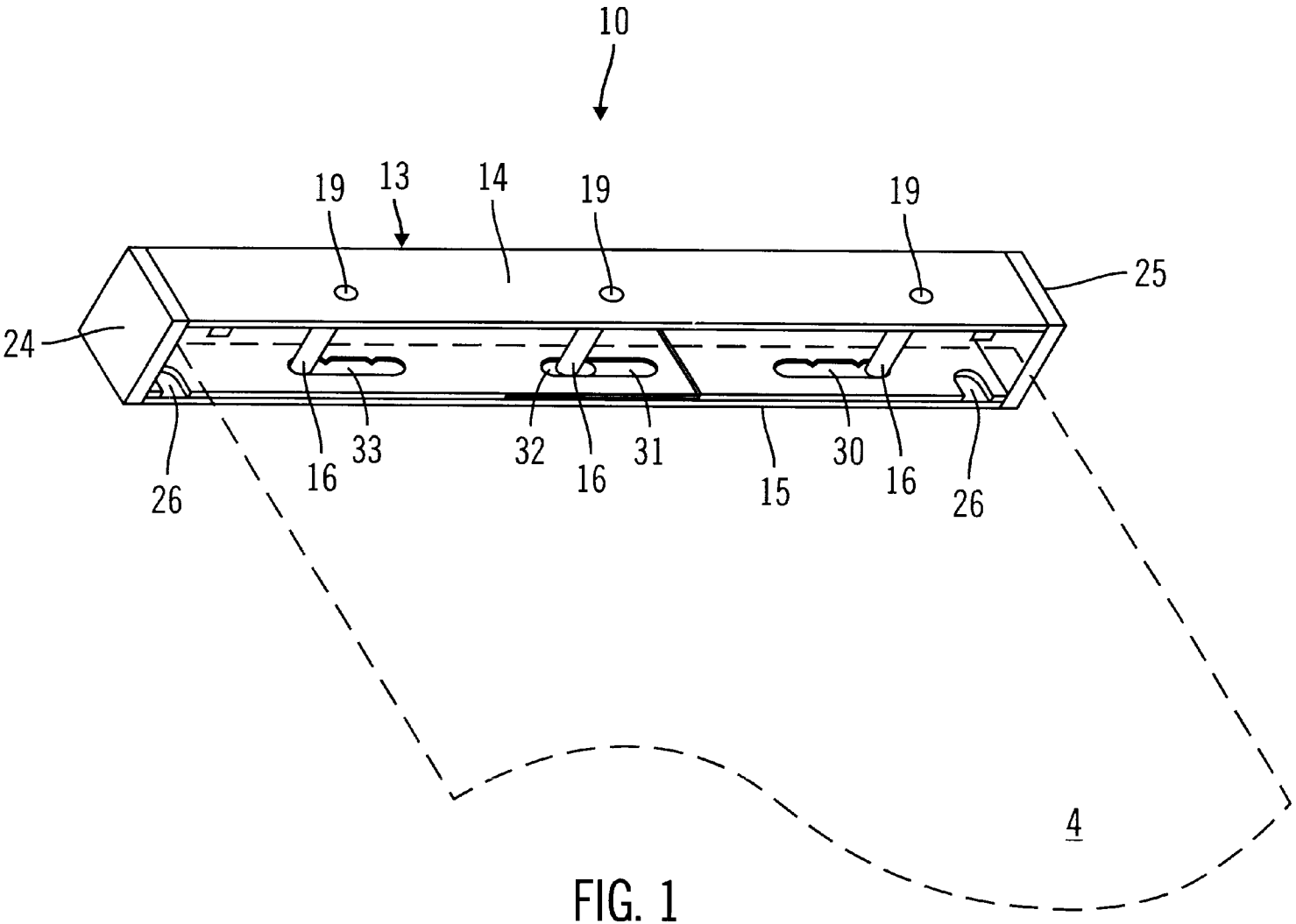
FIG. 1 is a perspective view of a hanging binder in accordance with one embodiment of the present invention, with the hangers retracted.

Referring to FIGS. 3B to 5, the hanger members 20 and 22 have a generally L-shaped cross-section, except at the ends 24 and 25. The ends 24 and 25 are generally U-shaped in cross-section, and have generally U-shaped notches 26 on the sides, which define hangers 27 for riding on hanging file support rails typically provided in file drawers and the like. The hanger members may be made out of the same materials that can be used to make the spine. At the other ends 28 and 29 of the hanger members 20 and 22, the hanger members can slide relative to one another in a telescopic manner. The end 28 is reduced in overall size to fit inside of the end 29. FIGS. 2, 3 4B show the hanger members in an extended state; FIGS. 1 and 4C show the hanger members in a fully retracted state.

On each hanger member, there are two elongated slots (30, 31, 32, 33). The slots 30–33 are positioned such that the posts 16 extend through the slots 30–33 in the assembled binder. In the assembled state, the slots 31 and 32 overlap at the center post 16. The slots 30–33 are so sized and positioned such that in the fully extended position of the hanger members 20 and 22, the posts 16 stops at the inside ends 34–37 of the slots 30–33; and in the fully retracted. position, the posts 16 stops at the outside ends 38–41 of the slots 30–33. The slots 30 and 33 have generally V-shaped or half-round protrusions 44 along the longitudinal edges of the slots 30 and 33. The protrusions 44 are positioned from the ends 34, 37, 38 and 41 of the slots 30 and 33 such that the posts 16 are trapped by the protrusions 44 when the posts are against the ends 34, 37, 38 and 41 of the slots 30 and 33. When the hanger members are in the fully retracted state as shown in FIG. 4B, the posts 16 are trapped against ends 38 and 41 of slots 30 and 33. In the fully extended state as shown in FIG. 4C, the posts 16 are trapped against ends 34 and 37 of slots 30 and 33. The posts 16 can slide over the protrusions 44 upon applying a force to extend or retract the hanger members 30 and 33. To facilitate sliding over the protrusions 44, slots 46 are provided in parallel to the edge of the slots 30 and 33 on which the protrusions 44 are located, next to narrow adjoining strips 48. When a force is applied to slide the hanger members 30 and 33 relative to each other, the posts 16 press against the protrusions 44, and in a cam action, push the protrusion "aside" while the narrow adjoining strips 48 flex to give way laterally because of the slots 46.

The hanger members 30 and 33 are essentially supported in a cantilevered manner by the posts 16. Two posts 16 are needed to support each hanger member. By using a common center post 16 too support the inside end of each hanger member, the number of posts is reduced, thus simplifying the design and construction of the hanging binder 10.

The size of the hanging binder 10 may correspond to any standard size paper, such as A4 size, legal size, letter size, etc. The position and spacing of the posts 16 may correspond to the spacing of holes made by standard hole-punchers.

To file a paper in the hanging binder 10, the flap 13 is opened at its hinge at bend 2, away from the posts 16. The paper is placed against the back 13 with the posts 16 through holes punched along one edge of the paper. The flap 14 is closed onto the posts 16 with the tip 19 of the posts into the holes on the binder cover. The tips 19 of the posts 16 are snapped into the holes 18 on the flap 14, thus securing the paper on the posts 16. To remove a paper, the flap 14 is unsnapped from the posts 16 to provide access to the paper. FIG. 1 shows the hanging binder with papers 4 filed thereon. The hanger members may be retracted into the spine 12 to conceal the hanger 27 when the hanging binder 10 is not placed in a hanging file drawer. This provides a clean elegant binder that can be handled without the hangers 27 getting in the way. When the binder 10 is placed in a file drawer, the hanger members 20 and 22 are extended to expose the hangers 27. The binder is supported with the hangers 27 riding on rails typically provided in a file drawer, in which the papers filed thereon will hang vertically.

Unlike the four-pin structure, which requires snapping and-unsnapping of four posts to place and remove papers from the binder, less posts used in the present invention results in a structure that requires less effort for a person to use the binder 10.

In another aspect of the present invention, hanging binder supports are designed to complement usage of the hanging binder to provide filing of loose-leaf papers. As shown in FIG. 8, in accordance with one embodiment of the present invention, a hanging file sleeve or box 50 provides support for portable storage of hanging file. The box 50 has a rectangular sleeve 52 having an opening 54. Inside the opening, at two opposing ends are support rails 56. In the embodiment shown, the opening is a narrow rectangular shape, and the support rails are slats oriented with their edges facing towards the opening. The size of the sleeve 52 and the spacing between the rails 56 are such to match the hanger 27 when they are fully extended from the spine 12. The hanging binder 10 can be inserted in the sleeve 52 and supported on the rails at the hangers 27. The distance between the rails 56 and the edge of the opening 54 may be such that the back 13 of the binder 10 would be flush with the edge of the opening 54 when the binder 10 is supported on the rails 56. This results in an elegant profile. To facilitate removal of binders 10 from the sleeve 52, the panels at the sides of the opening 54 are provided with cutouts 58.

It is noted that while the box 50 is designed for supporting hanging binders 10 horizontally (i.e., the opening 54 horizontal), the box 50 may be stored on a shelf with the opening 54 vertical. It is expected that one would typically insert and remove binders 10 with the opening horizontal. The width of the sleeve 52 may be any size desired to hold a desired number of hanging binder 10. The hanging binders 10 may be color coded in accordance with subject matter.

Referring to FIG. 9, in accordance with another embodiment of the present invention, a hanging file carrying case 60 provides easy transport and handling of hanging files. The case 60 is essentially similar in structure as the box 50 in the previous embodiment, with the exception that a carrying handle 62 is provided on an additional panel 64 that closes the opening 66. There is also a panel 68 that has a clasp, latch or other types of fastener 69 that secures the panel 68 in a closed position. There are rails 67 and cutouts 65 as in the previous embodiment. Optional flaps 63 may be provided at opposing ends of the opening 66. This may be folded and tucked under the panel 64 to protect the hanging binders 10 carried in the case 60.

The case 60 and the sleeve 52 may be made of a rigid material, such as plastic or metal.

Referring to FIG. 10, in accordance with a further embodiment of the present invention, a foldable hanging file base 70 facilitates storage of the case during shipping and saves space when not in use. The base 70 has comprises a frame structure of slender members 72. The members 72 may be made from solid rods or hollow tubes of light metal or plastic. Two horizontal members 74 provide the support rails for hanging binders 10 shown in dotted lines in FIG. 10. Soft or flexible panels 71 may be supported or draped between the members 72 to form an enclosure to provide protection of the contents from the environment. The frame structure may be folded or collapsed at hinge 76 to a generally flat profile when the case 60 is not in use.

In another aspect of the present invention, a hanging binder supports a receptacle that provides filing of lose papers and/or articles. Referring to FIG. 11, in accordance with one embodiment of the present invention, the receptacle is in the form of an envelope or a file pocket 80, which has holes 82 punched along flange 83 for hanging on the posts 16 on the hanging binder 10. The file pocket 80 may have a flap 84 that closes an opening in the file pocket 80 for insertion of papers or articles by means of a Velcro fastener 88 or other types of releasable fastener or clasp. The file pocket 80 may be made of clear, colored and/or translucent plastic. A label holder 86 may be provided on the front of the file pocket 80 for holding a content identification label.

While the invention has been described in detail with respect to the illustrated embodiments in accordance therewith, it will be apparent to those skilled in the art that various changes, modifications, substitutions, alterations and improvement may be made without departing from the scope and spirit of the invention as defined by the appended claims.

What is claimed is:

1. A hanging file system, comprising:

a hanging binder that comprises:

an elongated spine generally of a U-shaped channel shape;

first and second hanger members slidably coupled to the U-shaped channel of the spine; and three posts located along the spine, extending across the U-shaped channel of the spine, and supporting the hanger members to slide in the U-shaped channel of the spine, wherein one of the three posts that is at mid-length of the spine is a common support for the first and second hanger members, and wherein the three posts receive papers with matching holes punched to be filed with the hanging binder.

2. A hanging file system as in claim 1 wherein the post that is the common support is at a center of the three posts along the spine.

3. A hanging file system as in claim 2 wherein the first hanger member has an end that overlaps an end of the second hanger member, said end of the first hanger member slides over said end of the second hanger member.

4. A hanging file system as in claim 3 wherein said end of the first hanger member and said end of the second hanger member slide relative to each other in a telescopic manner.

5. A hanging file system as in claim 4 wherein the spine has first and second flaps joined by a back; wherein the three posts extend from the first flap to the second flap, the second flap is hingedly connected to the back, and the second flap releasably interlocks with the three posts.

6. A hanging file system as in claim 5 wherein the second flap and the three posts releasably interlock by a snap structure, in which matching holes snap onto ends of the three posts.

7. A hanging file system as in claim 6 wherein each hanger member having a hanger at an extended end, wherein the first and second hanger member slides from a first position in which the hangers of the first and second hanger members are concealed within the spine, and a second position in which the hangers of the first and second hanger members are extended beyond the spine.

8. A hanging file system as in claim 1, further comprising a case having matching support for the hangers of the hanging binder.

9. A hanging file system as in claim 8, wherein the case comprises at least one of the following:

a file sleeve;

a carrying case; and a foldable hanging file base.

10. A hanging file system as in claim 9, wherein the file sleeve comprises a casing having an opening for receiving the hanging binder, and two support rails at each end of the opening for supporting the hangers of the hanging binder.

11. A hanging file system as in claim 10, wherein the casing of the file sleeve has a cutout at the opening to facilitate removal of the hanging binder.

12. A hanging file system as in claim 9, wherein the carrying case comprises a casing having an opening for receiving the hanging binder; two support rails at each end of the opening for supporting the hangers of the hanging hinder; a flap for covering the opening; and a handle provided on the flap to facilitate handling of the carrying case.

13. A hanging file system as in claim 9, wherein the case comprises at least a foldable hanging file base and said foldable hanging file base comprises a frame member that can be folded or collapsed to a generally flat profile; and matching support rails for supporting the hangers of the hanging binder.

14. A hanging file system as in claim 13, wherein the foldable hanging file base further comprises soft or flexible materials extending between the frame members to form an enclosure.

15. A hanging file system as in claim 1, further comprising a file pocket structured to secure contents held within, and adapted to be supported by the posts of the hanging binder.

16. A hanging file system as in claim 15, wherein the file pocket has an edge having matching holes for support by the three posts.

17. A hanging file system as in claim 15, wherein the file pocket has a flange having matching holes for support by the three posts.

18. A hanging file system as in claim 17, wherein the file pocket resembles an envelope having a flap cover to provide closure of the envelope.

19. A hanging file system as in claim 18, wherein the file pocket further comprises a releasable fastener for securing closure of the flap cover.

20. A hanging binder, comprising:

an elongated spine generally of a U-shaped channel shape;

first and second hanger members slidably coupled to the U-shaped channel of the spine; and three posts located along the spine, extending across the U-shaped channel of the spine, and supporting the hanger members to slide in the U-shaped channel of the spine, wherein one of the three posts that is at mid-length of the spine is a common support for the first and second hanger members, and wherein the three posts receive papers with matching holes punched to be filed with the hanging binder.

* * * * *